US007946067B2

(12) United States Patent
Lambert

(10) Patent No.: US 7,946,067 B2
(45) Date of Patent: May 24, 2011

(54) PICTURE FRAME WITH TILT DISPLAY AND SUPPORT

(76) Inventor: Gary F. Lambert, Oldsmar, FL (US)

( * ) Notice: Subject to any disclaimer, the term of this patent is extended or adjusted under 35 U.S.C. 154(b) by 195 days.

(21) Appl. No.: 11/781,857

(22) Filed: Jul. 23, 2007

(65) Prior Publication Data

US 2009/0025266 A1 Jan. 29, 2009

(51) Int. Cl.
*A47G 1/06* (2006.01)

(52) U.S. Cl. ..... 40/754; 40/768; 40/773

(58) Field of Classification Search ..... 40/737, 40/768

See application file for complete search history.

(56) References Cited

U.S. PATENT DOCUMENTS

| | | | | |
|---|---|---|---|---|
| 3,553,872 | A * | 1/1971 | Ebner | 40/711 |
| 5,533,288 | A * | 7/1996 | Lambert | 40/754 |
| 6,105,287 | A * | 8/2000 | Williams | 40/124.5 |
| 6,379,765 | B1 * | 4/2002 | Woods | 428/40.1 |
| 6,460,280 | B1 * | 10/2002 | Haines-Woon | 40/768 |
| 6,574,896 | B1 * | 6/2003 | Howell | 40/737 |
| 6,692,806 | B2 * | 2/2004 | Woods | 428/40.1 |
| 6,827,812 | B2 * | 12/2004 | Woods | 156/291 |

* cited by examiner

*Primary Examiner* — Joanne Silbermann
*Assistant Examiner* — Shin Kim

(57) ABSTRACT

A picture frame comprising a block of foam attached to a flat cardboard backing with a hole formed therein to allow the picture frame to be mounted on a wall; a first double sided adhesive tape on the low-tack side attachable to a back surface of the picture; a support structure for the picture frame comprising an extended portion of the flat cardboard backing, wherein a proximal end of the extended portion is connected to the cardboard backing along a hinge and the distal end of the extended portion extends to an edge of the cardboard backing opposite the hinge, the extended portion having a perforated line dividing it to a first part and a second part.

6 Claims, 3 Drawing Sheets

PICTURE FRAME WITH TILT DISPLAY AND SUPPORT

TECHNICAL FIELD

The present disclosure relates generally to picture frames and greeting cards, and more particularly to a greeting card picture frame for quick, easy and convenient mounting and display of pictures, artwork and the like.

BACKGROUND

Attractive greeting cards are now very popular, some of which are worthy of displaying. However, the display process may be cumbersome, requiring the receiver to go out, purchase a frame and engage in the tedious task of mounting the photograph or artwork in the frame.

For example, the receiver will need to remove the clips in the picture frame, take out the backing and matte and then positioned the picture on the backing before fitting them into the frame with the matte. The clips are then replaced and the picture is ready for hanging, but not until after considerable effort.

U.S. Pat. No. 5,533,288 teaches a frame design that allows greeting cards to be mounted in a more convenient manner using a double-sided adhesive tape, on the center of the mounting surface, to allow a picture to be positioned and secured by pressing it down on the adhesive surface of the tape. A matteboard which has double-sided adhesive tapes is then applied securing the picture in the frame. A flat backing having a folding portion equal to the entire width of the frame can be unfolded in an open position to provide a self-contained support system.

Unfortunately, the above design is awkward to use. The adhesive tapes located on the matteboard may cling to commercial packaging, making it difficult for consumers to remove the matteboard without damaging the adhesive. Further, the integrated stand extends too far making it inconvenient to stand the frame on a surface close to a back wall or other objects. It would be advantageous to design a frame, which can be easily removed from commercial packaging, and can be easily and effortlessly positioned on a surface in close proximity to other objects.

SUMMARY

Figure 1:
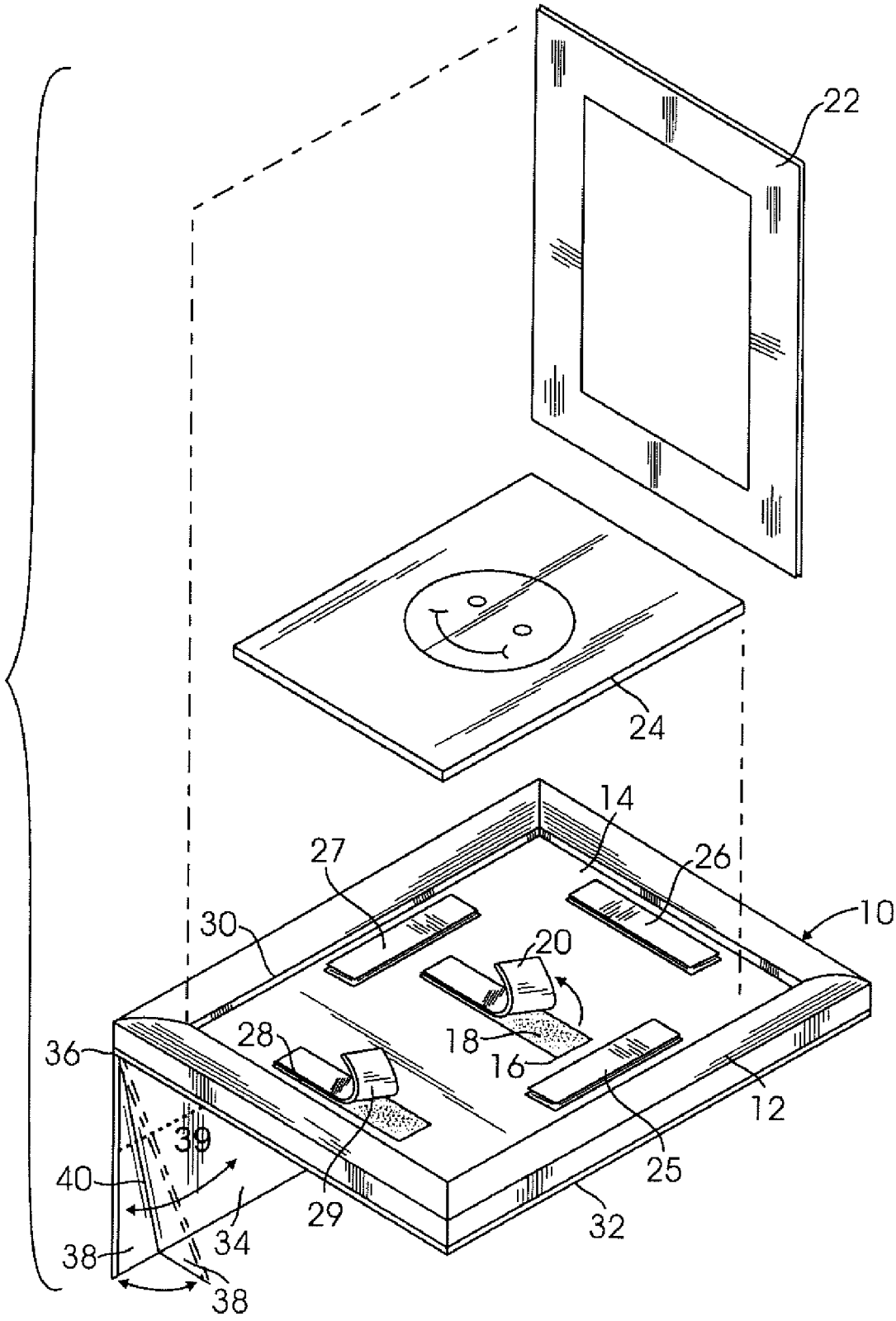
FIG. 1 is an exploded perspective view of a greeting card picture frame according to one embodiment.

According to one embodiment, an apparatus comprising a block of foam having a planar upper surface for receiving a picture and a surface opposite the planar upper surface attached to a flat cardboard backing is provided. The apparatus may further comprise a first double sided adhesive tape having a hi-tack side and a low-tack side, the first double-sided adhesive tape attached on the hi-tack side to the upper surface of the block of foam, and on the low-tack side attachable to a back surface of the picture. Additionally, the apparatus may also have a matte board having an inner opening dimension sufficient to display the picture.

The apparatus may also have a set of double sided adhesive tapes having both sides hi-tack, comprising a first pair of oppositely positioned strips along the top and bottom edges of a mounting surface and a second pair of oppositely positioned strips along the side edges of the mounting surface. The mounting surface is adhered to the upper surface of the block of foam, and the set of double sided adhesive tapes are configured for attaching the back surface of the matte board to the mounting surface such that when the matte board is attached to the mounting surface, the matte board firmly holds in place a marginal circumference of the picture, positioned over the first double sided adhesive tape.

The apparatus may further comprise a decorative frame attached to and enclosing an outer edge of the block of foam, which has a recess along an inner edge of the decorative frame having a depth sufficient to receive a periphery of the matte board. Additionally, there may be a support structure for the picture frame incorporated within the flat cardboard backing comprising an extended portion of the flat cardboard backing. The extended portion may have a thickness that is greater than the thickness of the flat cardboard backing and the width of the extended portion may be approximately equal to one fourth of the width of the block of foam such that in an open position the extended portion can be used as a base, so that the picture frame can rest on a horizontal surface.

The support structure may comprise the flat cardboard backing secured to a lower surface of the block of foam, in which a portion of the flat cardboard backing extends beyond an edge of the block of foam. The support structure may also comprise a crease in the flat cardboard backing along the edge of the block of foam forming a hinge, and a hinged portion created by the crease. Further, the support structure may comprise a foot formed on the hinged portion to support the picture frame at a slightly tilted angle. The foot may be formed by a crease in a corner of the extended portion of the flat cardboard backing.

The crease in the flat backing, along the edge of the block of foam, may be perforated; by which the extended portion of the flat cardboard backing may be easily separated from the block of foam. Additionally, the apparatus may comprise a slot formed in the lower planar surface of the block of foam; the slot constructed to allow the frame to be mounted on a wall when the extended portion is detached.

DESCRIPTION OF EXAMPLE EMBODIMENTS

An exemplary embodiment of a greeting card picture frame that can be quickly and easily assembled by any inexperienced user is illustrated in FIG. 1. The picture frame 10 has a decorative border 12 forming a mounting surface 14 flush with the frame 10. One or more double-sided adhesive tapes 16 may be provided at the center of mounting surface 14.

Preferably, double-sided adhesive tape 16 has a strong adhesive (i.e., hi-tack) on the surface pressed against the mounting surface 14, and a low strength (i.e., lo-tack) adhesive 18 on the opposite or upper side. A release paper 20 may cover the lo-tack adhesive until ready for use. Release paper 20 may not be present in all embodiments.

As shown, double-sided adhesive tape strips 26 and 28 may be provided along the top and bottom portion of the mounting surface 14, respectively. Additional adhesive tape strips 25 and 27 may be provided along the sides of the mounting surface 14, respectively. Adhesive tapes 25, 26, 27 and 28 may be covered with release paper 29 until ready to use. In a certain embodiment, release paper 29 may not be used. In such embodiment, the frame assembly 10 may be covered by way of a tight shrink wrap so that the cover does not come in contact with adhesive tapes 25, 26, 27 and 28.

Figure 2:
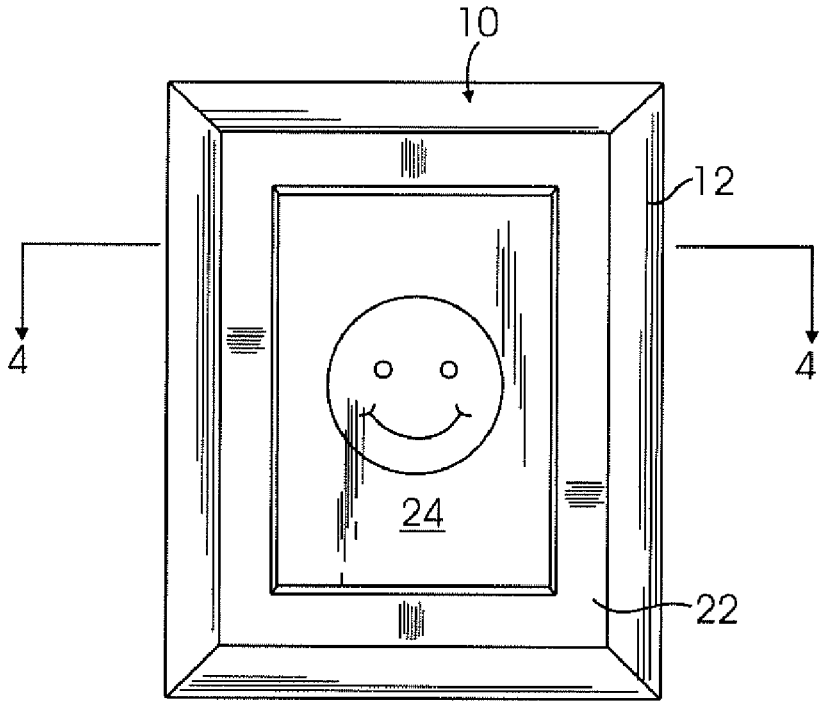
FIG. 2 is a front view of the greeting card picture frame having a picture mounted in accordance with one embodiment.

In one embodiment, double-sided adhesive tapes 25, 26, 27 and 28 have a hi-tack adhesive on both sides. The hi-tack feature allows the tapes to firmly hold a picture, artwork or image 24 in place on mounting surface 14. A matte board 22 is provided to cover the marginal circumference of a picture, artwork or image 24 placed over adhesive tape 18 on mounting surface 14. Frame 10 may be constructed to have a recess 30 with dimensions that equal the outside dimensions of matte board 22. This allows matte board 22 to firmly sit in decorative border 12 on mounting surface 14 to securely hold picture 24 in the frame, as shown in FIG. 2.

Figure 3:
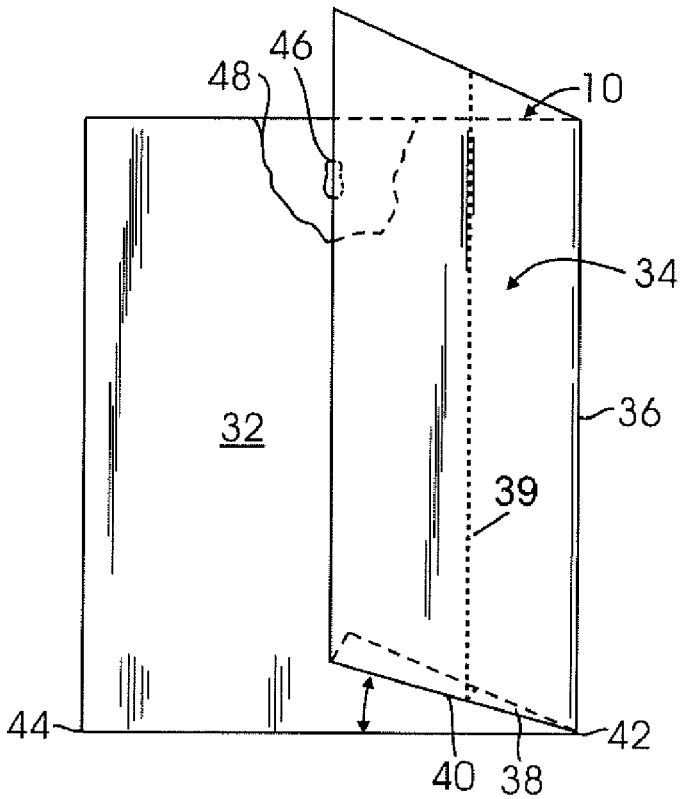
FIG. 3 is a rear view of the greeting card picture frame of FIG. 1 with a foldable flap in a partially open position.
Figure 4:
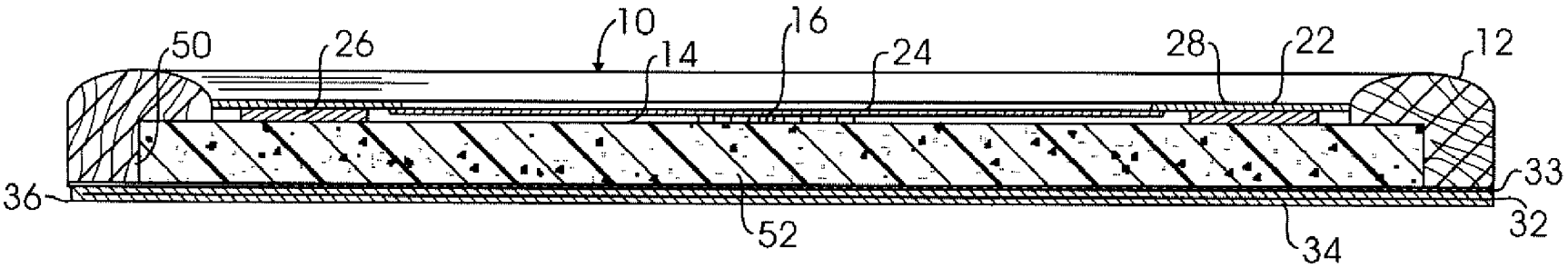
FIG. 4 is a sectional view taken at 4-4 of FIG. 2.

Referring to FIGS. 1 and 3, a self-contained support structure (e.g., easel or stand) is provided to allow the picture frame 10 to stand stably on a desktop, table top, or other horizontal surface. The support structure is formed by a flat backing 32 securely fastened by an adhesive to the rear of frame 10 as illustrated in FIG. 4. The flat backing 32 has an extended portion 34 which folds over flat backing 32.

The surface of the extended portion 34, in one embodiment, may be large enough to cover the entire surface of flat backing 32. In some embodiments, a perforated line 39 is provided on the extended portion 34 to divide the extended portion to a first part and a second part, such that the first part can be separated from the second part by cutting or tearing along the perforated line 39.

The second part may be approximately equal to one fourth the width of frame 10 (e.g., 4 inches) and provides a stand to hold the frame 10 on a horizontal surface. Extended portion 34 may be formed by creasing flat backing 32 along edge 36 of frame 10. This allows flat backing 32 to fold flat against the back of frame 10 as illustrated in FIG. 4.

In one embodiment, extended portion 34 may extend all the way along flat backing 32 or preferably partially (e.g., halfway, one fourth of the way, etc.) along the flat backing 32. Accordingly, as shown in FIGS. 1 and 3, extended portion 34 may be swung open around hinge 36 to provide a stand for frame 10. Advantageously, the embodiment that comprises a partially extended portion 34 can be placed closer to a wall or other items that may be in the immediate vicinity of the frame's 10 rear end (i.e., the back of the frame).

In some embodiments, extended portion 34 has a thickness that is greater than the thickness of flat backing 32. The additional thickness provides for greater support and resilience for frame 10, such that the extended portion 34 is durable and does not easily bend or become disfigured as the result of continued use. In some embodiments, flat backing 32 and extended portion 34 are of approximately the same thickness.

In a certain embodiment, when extended portion 34 is in an open position (i.e., when extended portion 34 forms an angle having a size greater than zero degrees with the flat backing 32) the frame 10 can be vertically supported on a horizontal surface, such that the frame 10 can form an approximately 90 degree angle with the horizontal surface.

In one embodiment, a foot for increased stability is provided to allow frame 10 to be tilted for improved viewing. Referring to FIG. 1, a foot 38 is provided by forming an oblique or diagonal crease 40 extending from lower corner of hinge 36 to an edge of extended portion 34. When folded under, as illustrated in phantom in FIG. 1, a triangular area comprising foot 38 is formed by way of crease 40. As such, foot 38 will provide a more stable and practical stand for supporting frame 10 for displaying picture 24 at a slightly tilted angle. This feature allows for improved viewing and convenient display.

Still another optional, but preferred, feature is the inclusion of a mounting hole 46 in the form of a keyhole slot in the back of frame 10 as shown in the area broken away at 48 as illustrated in FIG. 3. This allows frame 10, with picture 24, to be easily mounted on a wall. As an option, a push-pin (not shown) can be stored in keyhole slot 46 for hanging the picture frame. When mounting frame 10 on a wall, a first part of extended portion 34 formed between perforated line 39 and the distal edge of extended portion 34 is preferably removed to expose the mounting hole 46.

To aid in removing the first part of extended portion 34, in one embodiment, a user can tear or cut along the perforated line 39. In contrast with prior art teachings which required a user to cut along the hinge 36, this embodiment of the invention provides an advantage in that a second portion of the extended portion 34 formed between the perforated line 39 and the hinge 36 remains connected to the flat backing 32 so that it can be used later as a supporting stand or base as provided above.

Accordingly, in such embodiment, a user will have the option to later remove the frame 10 from the wall and place it on a horizontal surface using the second portion of the extended portion 34 as a stand. It is noteworthy that in the prior art models, once the extended portion 34 was detached from frame 10 along hinge 36, the option for using the extended portion 34 as the stand would no longer be viable.

Figure 5:
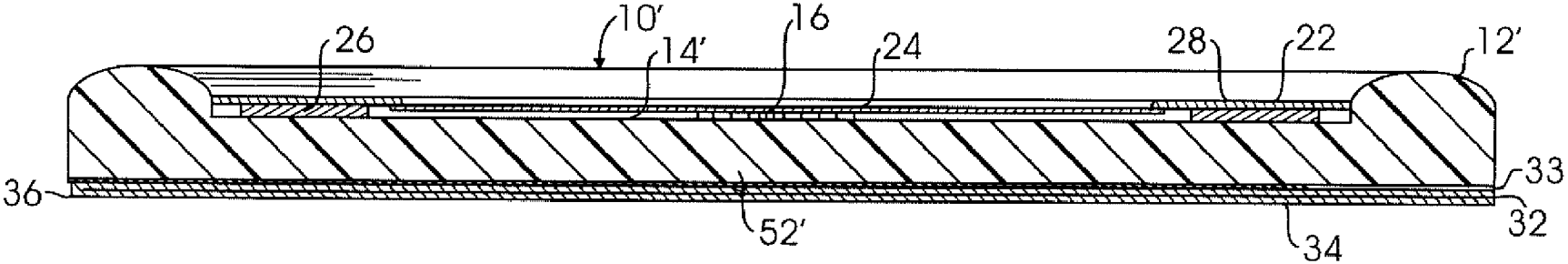
FIG. 5 is a sectional view of an optional embodiment of the invention.

In one embodiment, the frame 10 may be an integral part of the mounting surface 14 being exposed. The construction of two exemplary embodiments is illustrated in FIGS. 4 and 5. In FIG. 4, the instant picture frame is illustrated having a decorative border 12 that has a cavity 50 similar to traditional frames. This cavity is filled with a lightweight, preferably foam material 52 having a covering providing mounting surface 14. Proper construction of foam material 52 can produce an integrally formed flat durable mounting surface 14 on the top.

Preferably, foam material 52 is secured in frame 10 to provide an integral one-piece frame that needs no disassembly for mounting a picture, artwork or image 24. After constructing frame 10 with filler or block 52, flat backing 32 is securely attached to the back of frame 10 with an adhesive 33 and creased to form hinge 36 along one edge. The crease is also perforated to allow removal of folding part 34 for wall mounting.

An optional one-piece molded construction is illustrated in FIG. 5. In this embodiment, frame 10' is formed with a molded decorative border 12', which can have a variety of designs, formed on a block of molded material 52' having mounting surface 14'. Flat backing 32 forming hinge 36 and extended portion 34 is securely attached to the back of molded block 52' as before. Matte board 22 and picture 24 are secured to mounting surface 14' as before with double-sided adhesive tapes 16, 25, 26, 27 and 28.

Thus, there has been disclosed a greeting card picture frame which allows pictures to be quickly and easily mounted by any inexperienced user with the appearance of custom-framed pictures. The frame provides a solid one-piece construction with a decorative sculptured border and a mounting surface on a filler or molded integrally formed block material.

Double-sided adhesive tape 18, in the center of the mounting surface, allows a picture 24 to be easily positioned for display. Double-sided adhesive tapes 25, 26, 27 and 28 provided along the edges of the mounting surface 14 allow the matte board 22 to be placed firmly over the picture or artwork 24 on the mounting surface 14, completing the process.

It should be understood that the invention can be practiced with modification and alteration within the spirit and scope of the appended claims. The description is not intended to be exhaustive or to limit the invention to the precise form disclosed. These and various other adaptations and combinations of the embodiments disclosed are within the scope of the invention and are further defined by the claims and their full scope of equivalents.

What is claimed is:

1. A picture frame comprising:

a block of foam having a planar upper surface for receiving a picture and a surface opposite the planar upper surface attached to a flat cardboard backing with a hole formed therein to allow the picture frame to be mounted on a wall;

a first double sided adhesive tape having a hi-tack side and a low-tack side, the first double-sided adhesive tape attached on the hi-tack side to the upper surface of the block of foam, and on the low-tack side attachable to a back surface of the picture;

a matte board having an inner opening dimension sufficient to display the picture when the matte board is placed over the picture;

a set of double sided adhesive tapes having both sides hi-tack, comprising a first pair of oppositely positioned strips along the top and bottom edges of a mounting surface and a second pair of oppositely positioned strips along the side edges of the mounting surface, wherein the mounting surface is adhered to the upper surface of the block of foam, wherein the set of double sided adhesive tapes are configured for attaching the back surface of the matte board to the mounting surface such that when the matte board is attached to the mounting surface, the matte board firmly holds in place a marginal circumference of the picture positioned over the first double sided adhesive tape such that a main area of the picture is displayable through the inner opening of the matte board;

a decorative frame attached to and enclosing an outer edge of the block of foam:

a recess along an inner edge of the decorative frame having a depth sufficient to receive a periphery of the matte board;

a support structure for the picture frame incorporated within the flat cardboard backing comprising an extended portion of the flat cardboard backing, wherein a proximal end of the extended portion is connected to the cardboard backing along a hinge and the distal end of the extended portion extends to an edge of the cardboard backing opposite the hinge, the extended portion having a perforated line dividing it to a first part and a second part, such that the first part is formed between the hinge and the perforated line and the second part is formed between the perforated line and the distal end of the extended portion;

wherein the perforated line is closer to the hinge than to the distal end of the extended portion;

wherein the second part can be separated from the first part to allow the first part to be used as a support stand so that the picture frame can rest on a horizontal surface, wherein the first part when folded over the flat cardboard backing does not cover the hole formed in the flat cardboard backing for the purpose of mounting the picture frame on the wall;

wherein said support structure comprises the flat cardboard backing secured to a lower surface of the block of foam;

a portion of the flat cardboard backing extending beyond an edge of the block of foam;

a crease in the flat cardboard backing along the edge of the block of foam forming the hinge:

a hinged portion created by the crease; and a foot formed on the hinged portion to support the picture frame at a slightly tilted vertical angle.

2. The picture frame according to claim 1 in which the foot is formed by a crease in a corner of the hinged portion.

3. The picture frame according to claim 1 in which the crease in the flat backing, along the edge of the block of foam, is perforated: by which the extended portion of the flat cardboard backing may be easily separated from the block of foam.

4. The picture frame according to claim 1 wherein the extended portion has a thickness that is greater than the thickness of the flat cardboard backing.

5. The picture frame according to claim 1 in which the double-sided adhesive tape in each instance has release paper covering the side with the lo-tack adhesive which can be peeled off to expose the lo-tack adhesive and quickly mount the picture and the matte board.

6. The picture frame according to claim 1 in which the decorative frame has a cavity along the inside periphery of the decorative frame for receiving an outer edge of the block of foam.

* * * * *